US009184534B1

(12) United States Patent
Errato, Jr. et al.

(10) Patent No.: US 9,184,534 B1
(45) Date of Patent: Nov. 10, 2015

(54) OVER-MOLD STRAIN RELIEF FOR AN ELECTRICAL POWER CONNECTOR

(76) Inventors: Andrew Errato, Jr., Milford, CT (US); Steven Burk, Simi Valley, CA (US)

( * ) Notice: Subject to any disclaimer, the term of this patent is extended or adjusted under 35 U.S.C. 154(b) by 524 days.

(21) Appl. No.: 13/590,918

(22) Filed: Aug. 21, 2012

Related U.S. Application Data

(60) Provisional application No. 61/580,050, filed on Dec. 23, 2011.

(51) Int. Cl.
*H01R 13/56* (2006.01)

(52) U.S. Cl.
CPC ..... *H01R 13/562* (2013.01)

(58) Field of Classification Search
CPC ..... H01R 13/562; H01R 13/5845; H01R 13/553; H01R 13/6335; H01R 2103/00
See application file for complete search history.

(56) References Cited

U.S. PATENT DOCUMENTS 3,986,765 A * 10/1976 Shaffer et al. ..... 439/314
4,255,007 A * 3/1981 Michaels et al. ..... 439/332
5,238,419 A * 8/1993 Roeder et al. ..... 439/164
5,340,330 A * 8/1994 Dolson et al. ..... 439/447
6,322,386 B1 * 11/2001 Tharp et al. ..... 439/344
6,431,904 B1 * 8/2002 Berelsman ..... 439/447
7,766,690 B2 * 8/2010 Walker et al. ..... 439/447
7,934,943 B2 * 5/2011 Malstrom et al. ..... 439/447
8,591,249 B2 * 11/2013 Harnish et al. ..... 439/474
8,845,359 B2 * 9/2014 Taylor et al. ..... 439/447
2007/0020989 A1 * 1/2007 Liu et al. ..... 439/447

* cited by examiner

*Primary Examiner* — Gary Paumen
(74) *Attorney, Agent, or Firm* — Steven M. McHugh

(57) ABSTRACT

An over-mold strain relief for an electrical connector-cable combination is provided and includes an electrical connector assembly having an electrical connector including an electrical connector base and an electrical cable, wherein the electrical cable includes a minimum bend radius and is connected to the electrical connector proximate the connector base. An over-mold material is also provided and is associated with the electrical connector assembly to cover a portion of the electrical connector and the electrical cable, wherein the over-mold material forms a strain relief portion having a strain relief portion length that covers the cable, wherein the strain relief portion includes a plurality of slots which are distributed along the strain relief portion length and wherein the strain relief portion length is within the range of between about 30% to about 60% of the minimum bend radius of the cable.

20 Claims, 21 Drawing Sheets

SECTION A-A

*SECTION B-B*

*SECTION C-C*

| Cable Type | Minimum Bending Radius as a Multiple of Overall Cable Diameter |
|---|---|
| Single or Multiple Conductor Cables without Metallic Shielding | 8 times the overall cable diameter |
| Single Conductor Cables with Shielding | 12 times the overall cable diameter |
| Multiple Conductor Cables with Individually Shielded Conductors | 12 times the individual cable diameter or 7 times the overall cable diameter -- whichever is greater |
| Portable (Mining) Cables | 6 times for cables rated 5000 volts or less, 8 times for cables rated over 5000 volt |
| Fiber Optic Cables | 10 times overall diameter for multimode cables, 20 times overall diameter for singlemode cables |
| Interlocked Armor or Corrugated Sheath (Type MC) Cables | 7 times overall cable diameter |

*FIG. 12*

OVER-MOLD STRAIN RELIEF FOR AN ELECTRICAL POWER CONNECTOR

RELATED APPLICATIONS

This application claims benefit of the filing date of U.S. Provisional Patent Application Ser. No. 61/580,050, filed Dec. 23, 2011, the contents of which are incorporated by reference herein in its entirety.

FIELD OF THE INVENTION

The present invention relates generally to an improved strain relief for an electrical power connector and more particularly to an improved strain relief for a heavy duty power connector that is more ergonomic and user friendly than traditional strain reliefs for heavy duty power connectors.

BACKGROUND OF THE INVENTION

Class L electrical power connectors are well known in the art and are standard heavy duty power connectors that have been in use for at least 50 years. These types of connectors are designed to Military Specification MIL-DTL-22992 to be suitable for heavy duty use in industrial and military applications. Typically, Class L connectors are configured with different shell sizes ranging from 28 to 52 and they are configured to operate with conductor sizes that range from size 6 to 4/0 AWG and are used to operate with electrical currents ranging from 40 to 200 amperes. Because these connectors are for heavy duty uses and large power applications, it is important, from a safety and operational perspective, that the connector has a reliable and suitably strong strain relief and that the shell maintains continuity to the ground pin(s) (this is also a requirement of the MIL-SPEC). In current Class L connectors this reliable strain relief is accomplished by using a wire mesh Kellems grip (See FIG. 1A). As shown in FIG. 1B, the Kellems grip is typically constructed from a stainless steel mesh that is attached a connector via an aluminum collar and aluminum compression nut, where the stainless steel mesh extends down a portion of the cable connected to the connector. This wire mesh acts as a strain relief for the electrical connector and cable and is attached to the connector as described in U.S. Patent Registration No. 5,015,805.

Unfortunately however, the Kellems grip used with current Class L connectors (as well as other connectors) has an undesirable characteristic in that, because these connectors are used in heavy duty applications that are typically outdoors, the Kellems grip is exposed to the environment. This exposure causes the Kellems grip to fray overtime causing individual wires of the wire mesh to stick out of the grip. Thus, when a user grabs the wire mesh portion of the grip, the frayed wires tend to pierce and cut the hand of the user. Moreover, as the grips become more worn, the strain relief functionality becomes degraded.

SUMMARY OF THE INVENTION

An over-mold strain relief for an electrical connector-cable combination is provided and includes an electrical connector assembly having an electrical connector including an electrical connector base and an electrical cable, wherein the electrical cable includes a minimum bend radius and is connected to the electrical connector proximate the connector base. An over-mold material is also provided and is associated with the electrical connector assembly to cover a portion of the electrical connector and the electrical cable, wherein the over-mold material forms a strain relief portion having a strain relief portion length that covers the cable, wherein the strain relief portion includes a plurality of slots which are distributed along the strain relief portion length and wherein the strain relief portion length is within the range of between about 30% to about 60% of the minimum bend radius of the cable.

An over-mold strain relief for an electrical connector-cable combination is provided and includes an electrical connector assembly having an electrical connector including an electrical connector base and an electrical cable having a minimum bend radius and is connected to the electrical connector proximate the connector base. An over-mold material is also provided and is associated with the electrical connector assembly to cover a portion of the electrical connector and the electrical cable, wherein the over-mold material forms a strain relief portion having a strain relief portion length that covers the cable, wherein the strain relief portion length is within the range of between about 30% to about 60% of the minimum bend radius of the cable.

A method for molding an over-mold strain relief is provided and includes creating an assembled connector assembly by connecting the conductors of a cable to an electrical connector, associating the assembled connector assembly with an over-mold mold and introducing a thermoplastic material into the over-mold mold to cause the thermoplastic material to cover at least a portion of the electrical connector and the cable, where the thermoplastic material that covers at least a portion of the cable is configured to have a material length and a plurality of slots distributed along the material length.

BRIEF DESCRIPTION OF THE DRAWINGS

The foregoing and other features and advantages of the present invention will be more fully understood from the following detailed description of illustrative embodiments, taken in conjunction with the accompanying drawings in which like elements are numbered alike in the several Figures:

FIG. 12 is a table illustrating a simplified version of actual industry MBR recommendations for different cable types.

DETAILED DESCRIPTION OF THE INVENTION

Figure 1A:
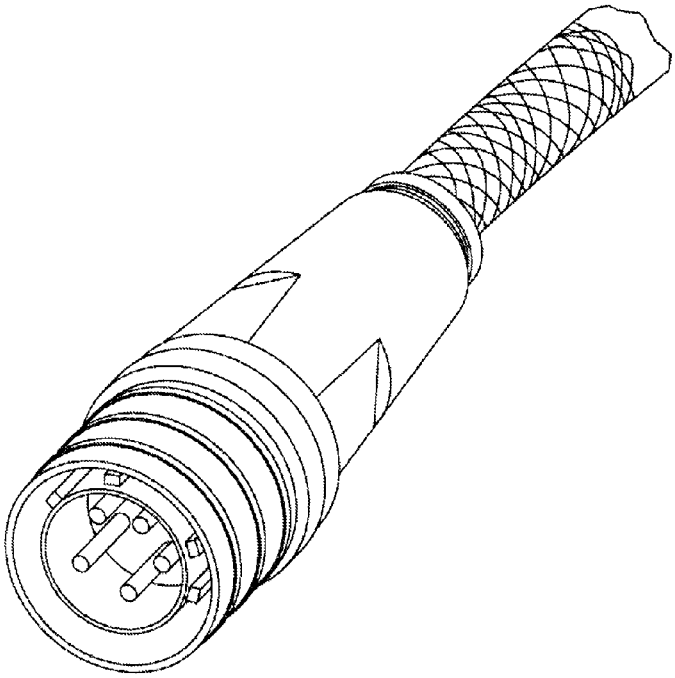
PRIOR ART FIG. 1A
FIG. 1A is a perspective view of a Class L connector and cable assembly showing a Kellems Grip, in accordance with the prior art.
Figure 1B:
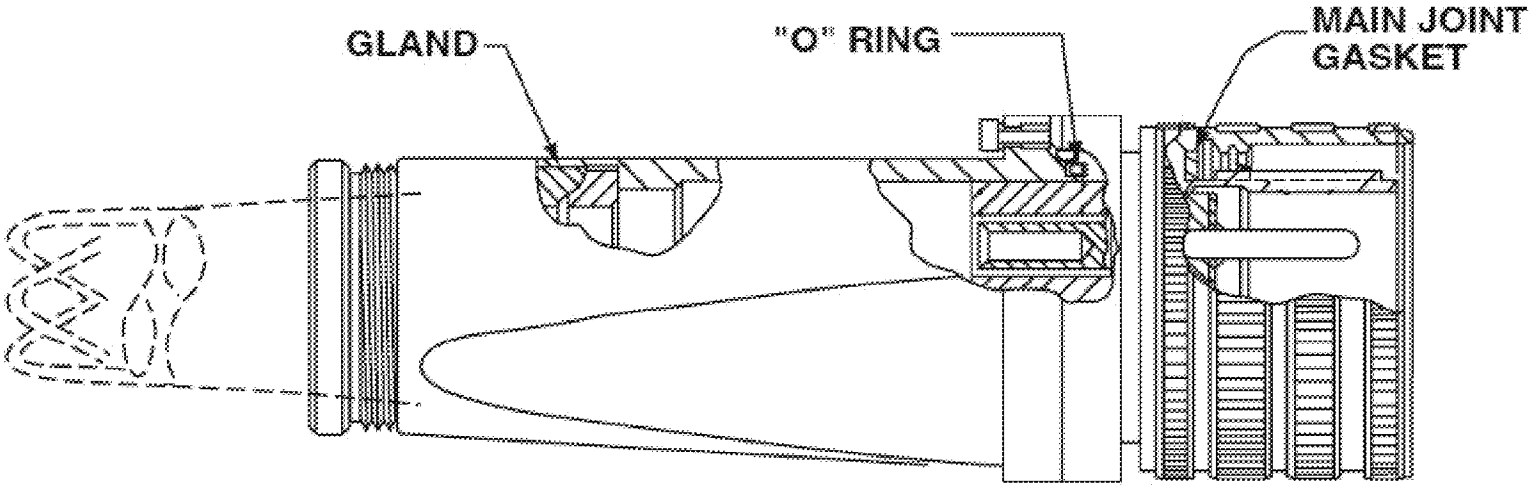
FIG. 1B PRIOR ART
FIG. 1B is a side sectional view of a connector and a Kellems Grip, in accordance with the prior art.
Figure 2A:
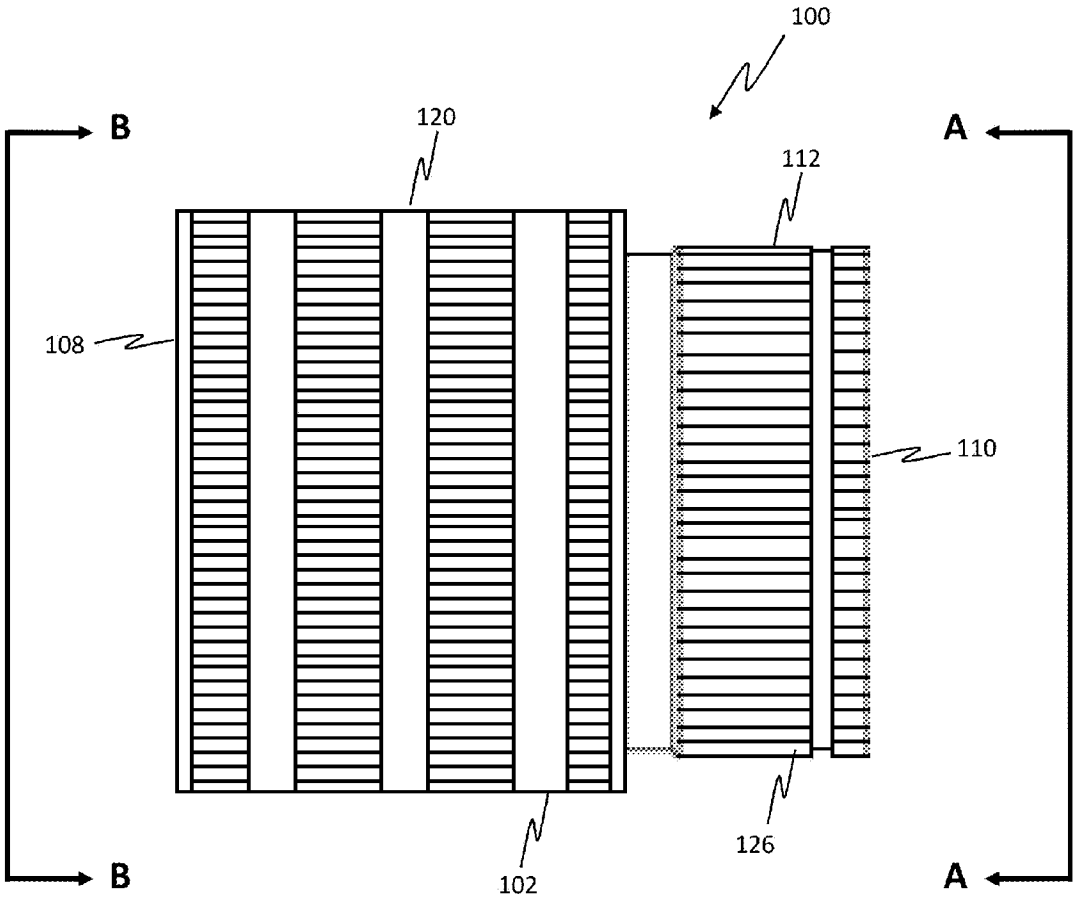
FIG. 2A is a side view of a male version Class L connector shell, in accordance with one embodiment of the present invention.
Figure 2B:
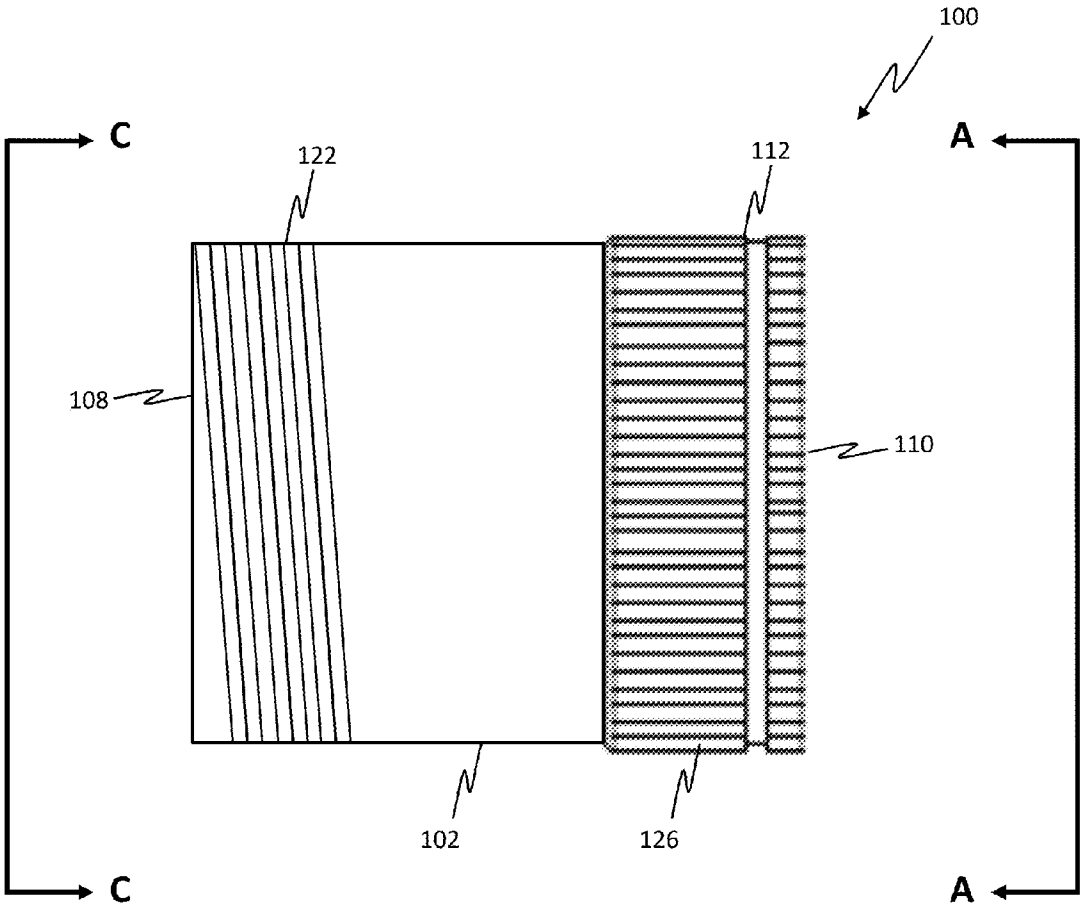
FIG. 2B is a side view of a female version Class L connector shell, in accordance with one embodiment of the present invention.
Figure 3A:
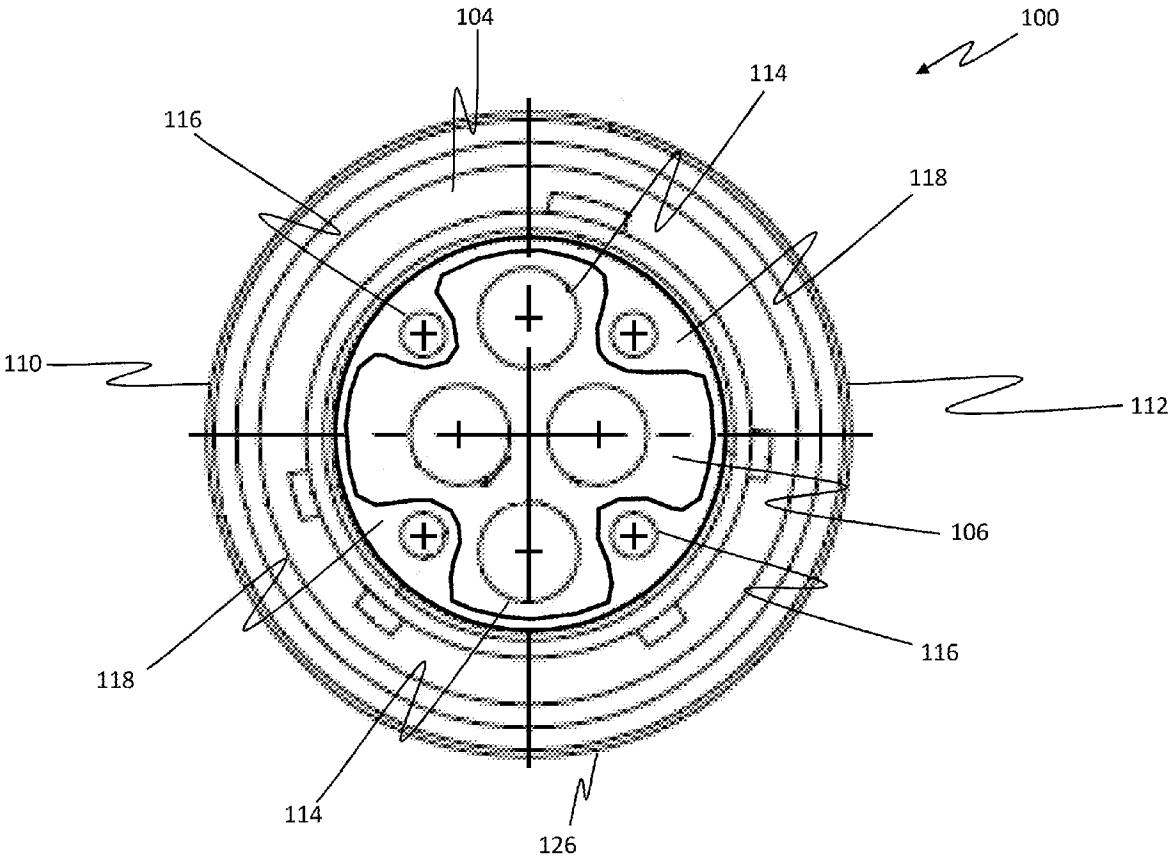
FIG. 3A is a rear end view of the Class L connector shell of FIGS. 2A and 2B, showing the plug/socket shell and contact insert.
Figure 3B:
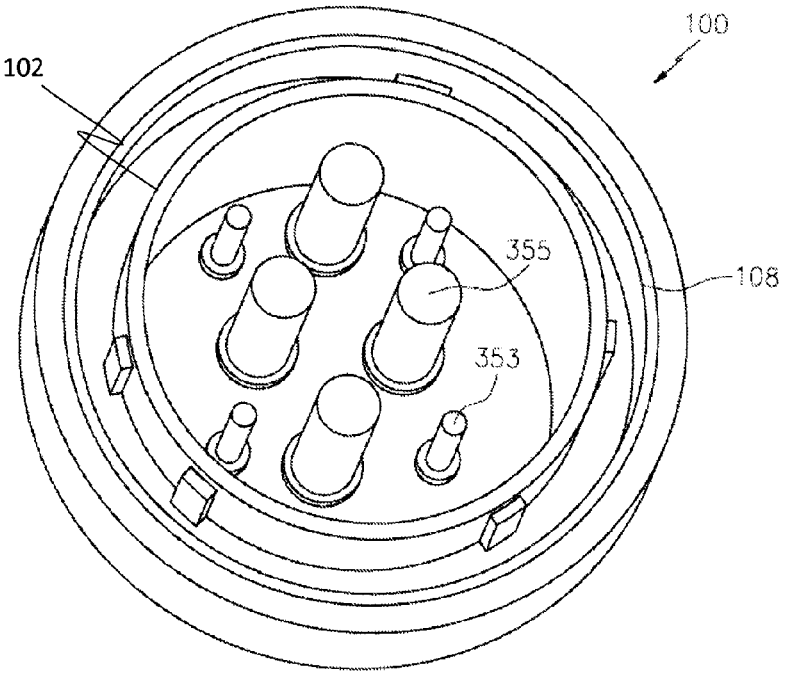
FIG. 3B is a front end view of the Class L connector shell of FIG. 2A, showing the male plugs of the connector.
Figure 3C:
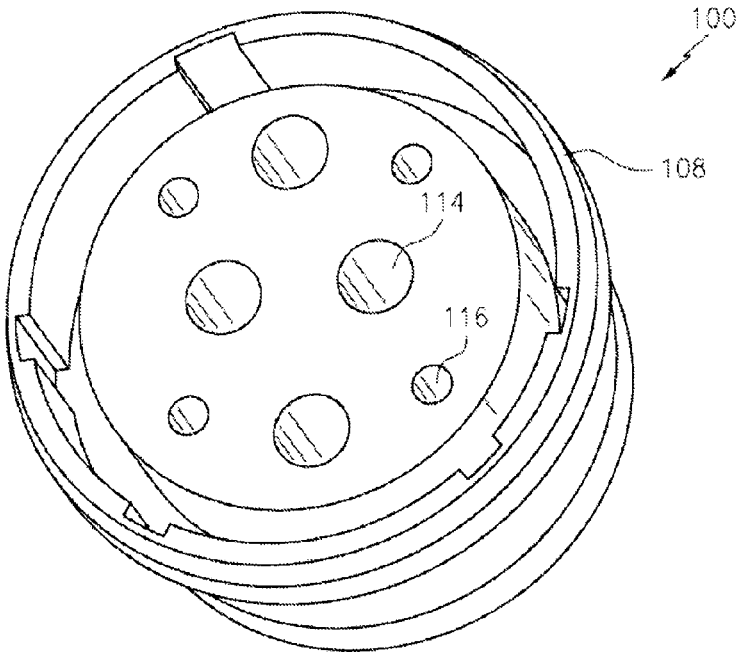
FIG. 3C is a front view of the Class L connector shell of FIG. 2B, showing the female sockets of the connector.

In accordance with the present invention, referring to FIG. 2A, FIG. 2B and FIG. 3A, an electrical connector 100 that conforms to MIL-DTL-22992 specifications is disclosed and includes a connector shell 102 defining a connector shell cavity 104 for containing a contact insert 106. The connector shell 102 includes a nose end 108 and a base end 110, wherein the nose end 108 is configured to connectively couple with a compatible connector. The connector shell cavity 104 includes a plug/socket shell portion 112 which contains at least a portion of the contact insert 106. The contact insert 106 includes at least one power contact carrier 114, at least one ground contact carrier 116 and a ground plane 118, wherein the ground plane 118 is conductively connected to the at least one ground contact carrier 116. It should be appreciated that the nose end 108 may include a coupling ring 120 (see FIG. 2A) for coupling with a compatible female connector or the nose end 108 may include a threaded surface 122 (see FIG. 2A) for coupling with a compatible male connector. It should be appreciated that the male version of the electrical connector 100 includes a contact insert 106 that is configured as a male (See FIG. 3B) and the female version of the electrical connector 100 includes a contact insert 106 that is configured as a female (See FIG. 3C), as described hereinafter.

Figure 4:
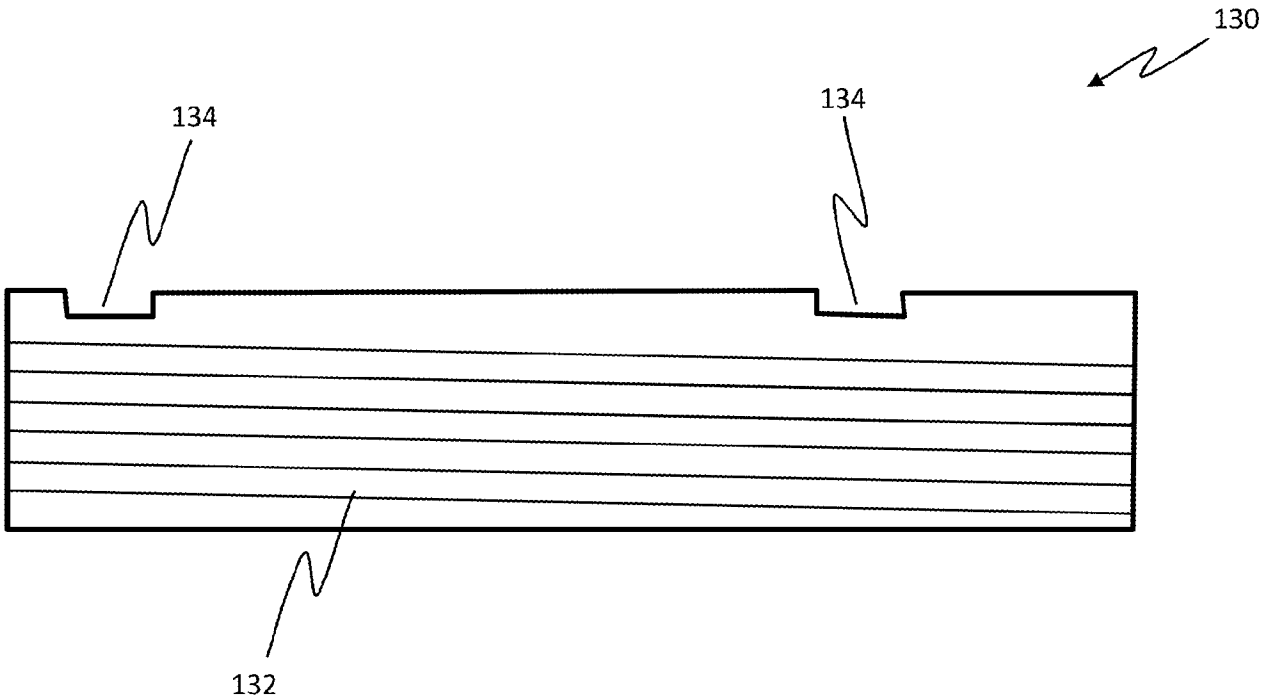
FIG. 4 is side view of the bonding nut of the Class L connector shell of FIG. 2A and FIG. 2B.
Figure 5:
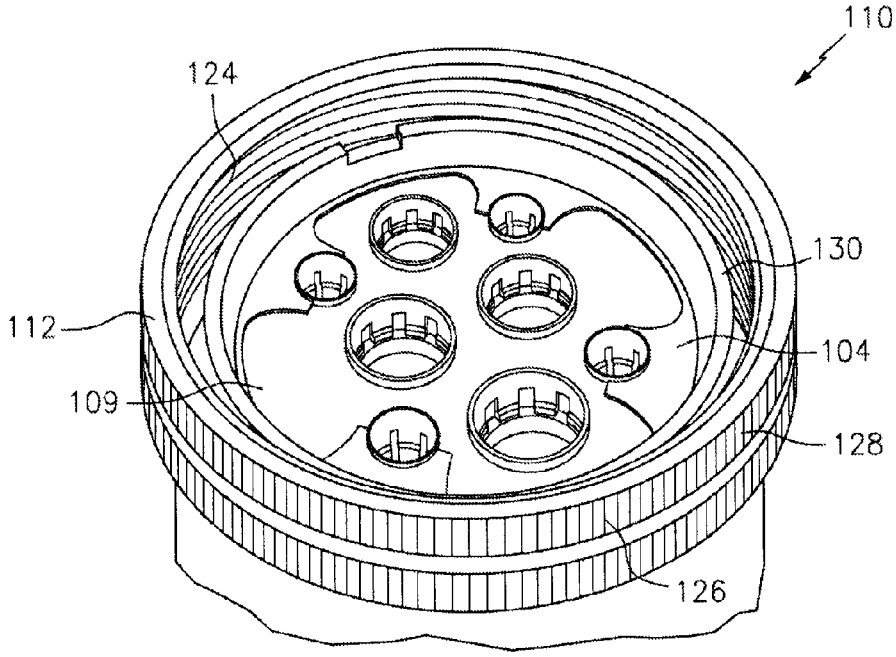
FIG. 5 is a rear side perspective isometric view of the plug/socket shell and contact insert of the Class L connector of FIG. 2A and FIG. 2B.

Referring to again to FIG. 3A as well as FIG. 4 and FIG. 5, the connector shell 102proximate the plug/socket shell portion 112 includes a plug/socket shell threaded inner surface 124 and an outer surface 126, where the outer surface 126 of the connector shell 102 may include a plurality of knurls/grooves 128. It should be appreciated that electrical connector 100 may include a pre-mold material as discussed hereinafter and that the knurls/grooves 128 may be configured to extend (fully or partially) along the circumference of the outer surface 126 to prevent/limit longitudinal movement of the pre-mold material and/or the knurls/grooves 128 may be configured to extend (fully or partially) along the length of the outer surface 126 to prevent/limit rotational movement of the pre-mold material. One example of such a configuration would include a crisscross pattern of knurls/grooves 128. Furthermore, the electrical connector 100 includes a bonding nut 130, where the bonding nut 130 includes a bonding nut threaded surface 132 and at least one adjustment notch 134. It should be appreciated that the bonding nut 130 is sized and shaped to be located within the connector shell cavity 104 proximate the plug/socket shell portion 112, wherein when the bonding nut 130 is located within the plug/socket shell portion 112, the bonding nut threaded surface 132 threadingly and securingly interacts with the plug/socket shell threaded inner surface 124.

It should be appreciated that the at least one adjustment notch 134 allows a tool to be used to install and remove the bonding nut 130 from the shell cavity 104. When being installed, a portion of the adjustment tool fits into the at least one adjustment notch 134 to engage the bonding nut 130 and to rotate the bonding nut 130 in a first direction to be threadingly and tightly screwed into the shell cavity 104 such that the bonding nut 130 compresses the ground plane 118. When being removed, the tool is used to rotate the bonding nut 130 in a second direction. It should be appreciated that the connector shell 102, the ground plane 118 and the bonding nut 130 are preferably constructed from a conductive material, such as a conductive metallic material. Accordingly, when the bonding nut 130 is tightly associated with the connector shell 102 such that the bonding nut 130 compresses the ground plane 118, the above arrangement advantageously provides ground continuity between the connector shell 102, the ground plane 118, the bonding nut 130 and the at least one ground contact carrier 116. It should be appreciated that the bonding nut 130 may also be installed without a tool.

Figure 6A:
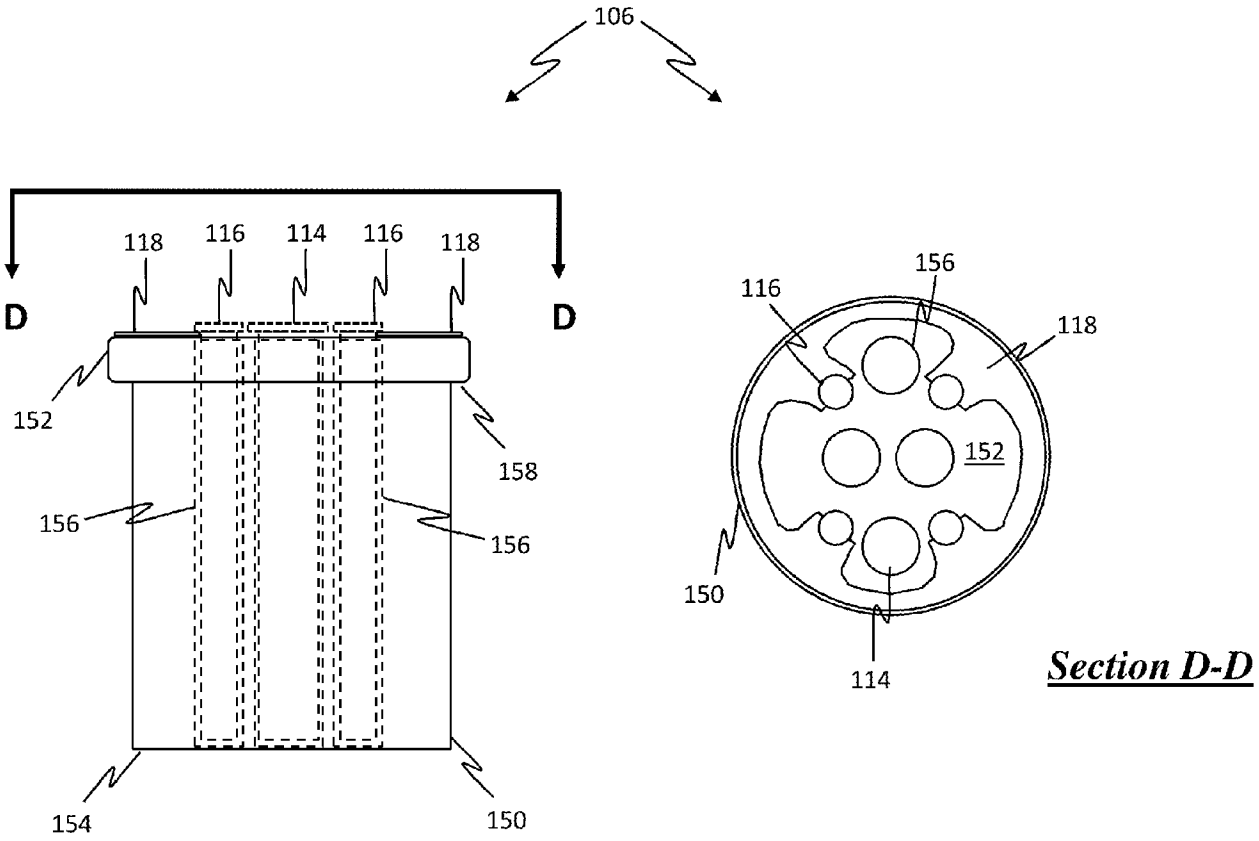
FIG. 6A is a side view and rear view of a female contact insert for the Class L connector of FIG. 2B, in accordance with one embodiment of the present invention.
Figure 6B:
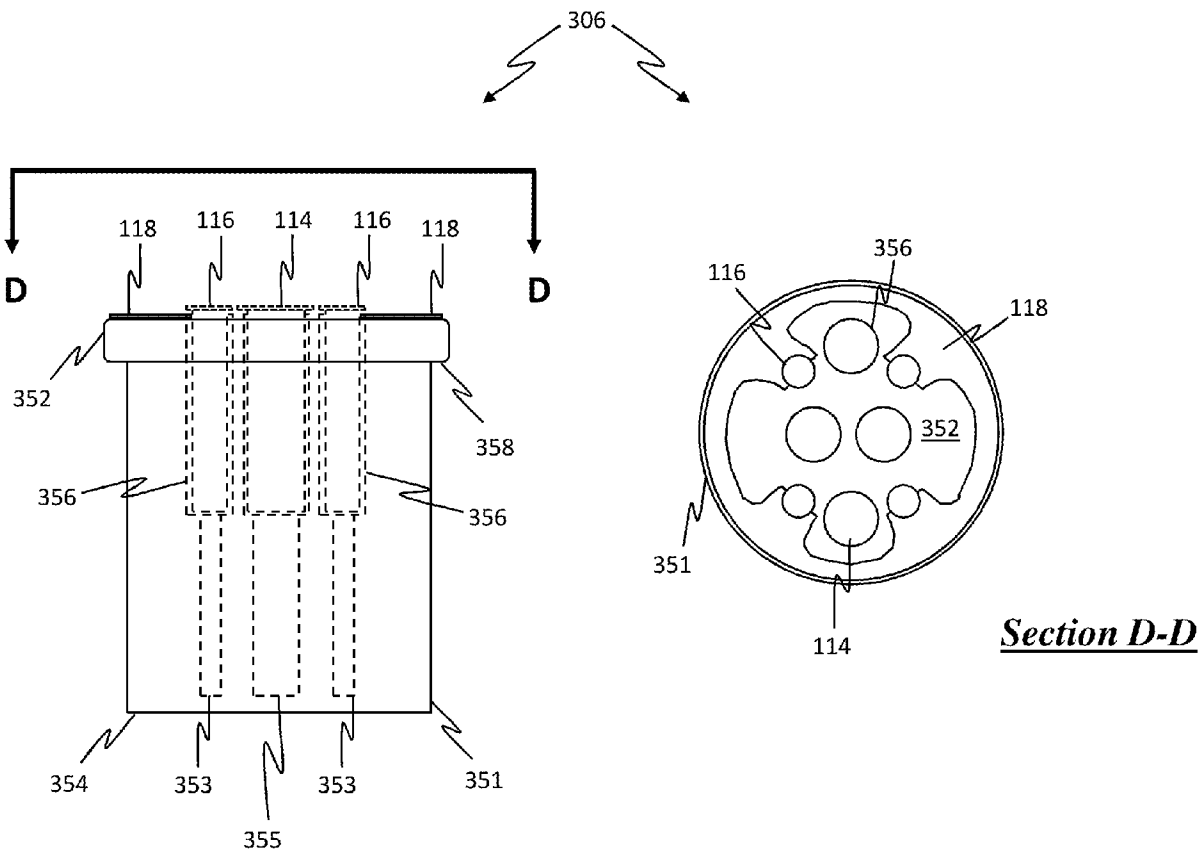
FIG. 6B is a side view and rear view of a male contact insert for the Class L connector of FIG. 2A, in accordance with one embodiment of the present invention.

Referring to FIG. 6A, one embodiment of a contact insert 106 is shown in accordance with the present invention and includes an insert body 150 having an insert front 154 and an insert rear 152, wherein the insert body 150 is configured as a female connector. The insert body 150 has a plurality of socket channels 156 that are configured to securely contain power contact carriers 114 and/or ground contact carriers 116, wherein the insert front 152 of the insert body 150 is configured as a female connector. The ground plane 118 is shown on the surface of the insert rear 152 and is conductively connected to ground contact carriers 116. Referring to FIG. 6B, another embodiment of a contact insert 306 is shown in accordance with the present invention and is configured as a male connector. In this embodiment, the insert body 351 also has a plurality of socket channels 356 that are configured to securely contain power contact carriers 114 and/or ground contact carriers 116, and the insert front 354 of the insert body 351 is configured as a male connector having one or more grounding plugs 353 and/or power/signal plugs 355.

It should be appreciated that in one embodiment, the insert rear 152, 352 has a greater diameter than the insert front 154, 354 such that a lip 158, 358 is formed. The contact insert 106, 306 is placed into the connector shell cavity 104 of connector shell 102 by inserting the contact insert 106, 306 into the opening of the connector shell 102 proximate the base end 110 to be located within the connector shell cavity 104 such that the insert front 154, 354 is proximate the nose end 108 and the insert rear 152, 352 is proximate the base end 110. The internal surface of the connector shell 102 has a rim (or protruding surface) and is configured such that when the contact insert 106, 306 is located within the connector shell 102, the lip 158, 358 of the insert body 150, 351 contacts the rim and is prevented from passing through the connector shell 102 and exiting out of the opening of the connector shell 102 proximate the nose end 108.

The insert rear 152, 352 includes a conductive ground plane 118 located on the surface of the insert rear 152, 352 where the ground plane 118 is conductively attached to the ground contact carriers 116. In accordance with the invention, the ground plane 118 may be conductively attached to the ground contact carriers 116 via any method suitable to the desired end purpose, such as soldering the ground plane 118 to the ground contact carriers 116. In still yet other embodiments, the ground plane 118 may be conductively attached to the ground contact carriers 116 via a mechanical connection (such as a clip or mounting screw) or the ground contact carriers 116 may be integrated with the ground plane 118 as one piece of conductive material.

It should be appreciated that the ground plane 118, ground contact carriers 116, bonding nut 130 and connector shell 102 are constructed from an electrically conductive material, such as a metallic material. This configuration advantageously allows for ground continuity when the electrical connector is assembled.

Figure 7:
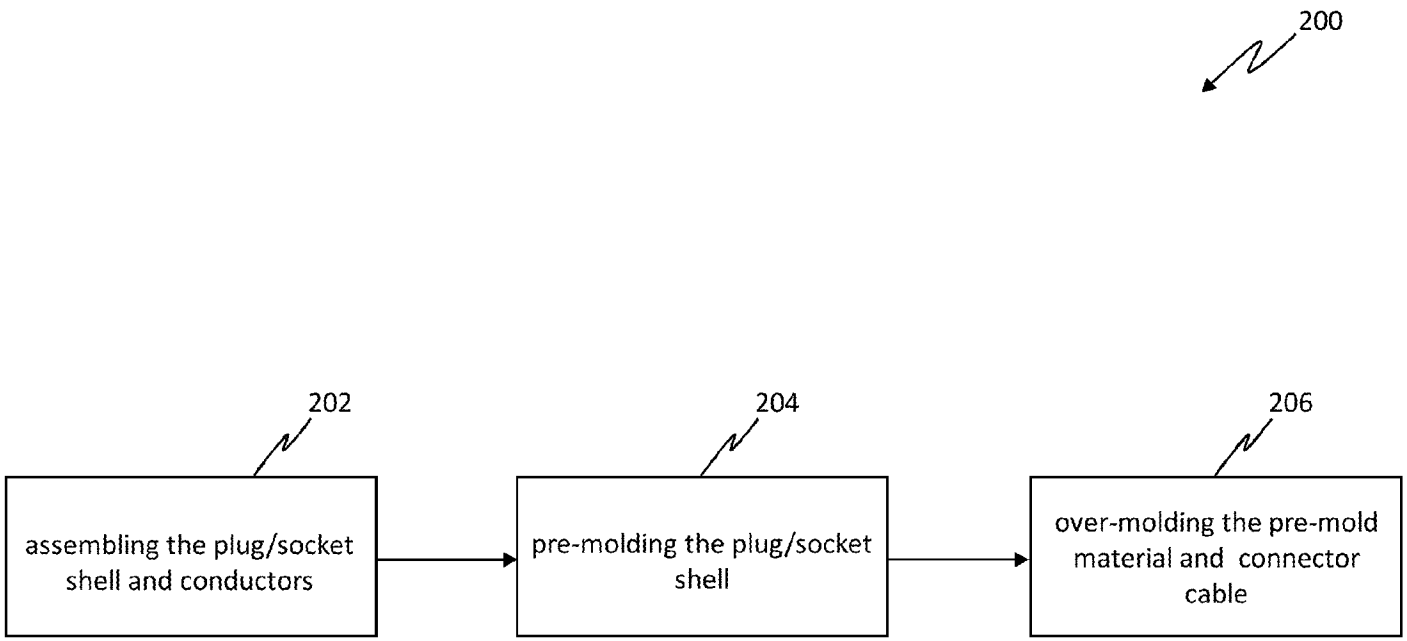
FIG. 7 is an operational block diagram illustrating a method for manufacturing the Class L connector of FIG. 2A and FIG. 2B, in accordance with one embodiment of the present invention.

Referring to FIG. 7, an operational block diagram 200 illustrating the overall process for assembling the electrical connector 100 is shown and includes configuring the connector shell 102 as described herein above, as shown in operational block 202. In accordance with one embodiment, the connector shell 102 may be assembled by inserting the contact insert 106, 306 into the connector shell cavity 104 such that the lip 158, 358 of the contact insert 106, 306 is resting on the rim or protruding surface located on the inner surface of the connector shell 102. It should be appreciated that the insert front 154, 354 is proximate the nose end 108 of the connector shell 102 and the insert rear 152, 352 is proximate the base end 110 of the connector shell 102. It should also be appreciated that the contact insert 106, 306 and the connector shell 102 are configured such that when the contact insert 106, 306 is contained within the connector shell cavity 104, a plug/socket shell cavity 109 exists proximate the base end 110 of the connector shell 102. The bonding nut 130 is associated with the base end 110 of the connector shell 102 by inserting the bonding nut 130 into the connector shell cavity 104 and rotating the bonding nut 130 to cause the bonding nut threaded surface 132 to engage with the plug/socket shell threaded inner surface 124 such that the bonding nut 130 is tightened against the ground plane 118. Is this way a ground continuity exists between the connector shell 102, the ground plane 118, the bonding nut 130, the at least one ground contact carrier 116 and the ground conductor that is located in the at least one ground contact carrier 116. Once the contact carrier 106 is assembled in the connector shell 102, the conductors (ground and/or power/signal conductors) of a cable can be securely and conductively attached to their respective contact carrier 114, 116, via any method suitable to the desired end purpose, such as by soldering, or by snap/friction fit. It should be appreciated that the connector shell 102 may be configured as a female shell or a male shell as discussed hereinbefore.

Figure 8:
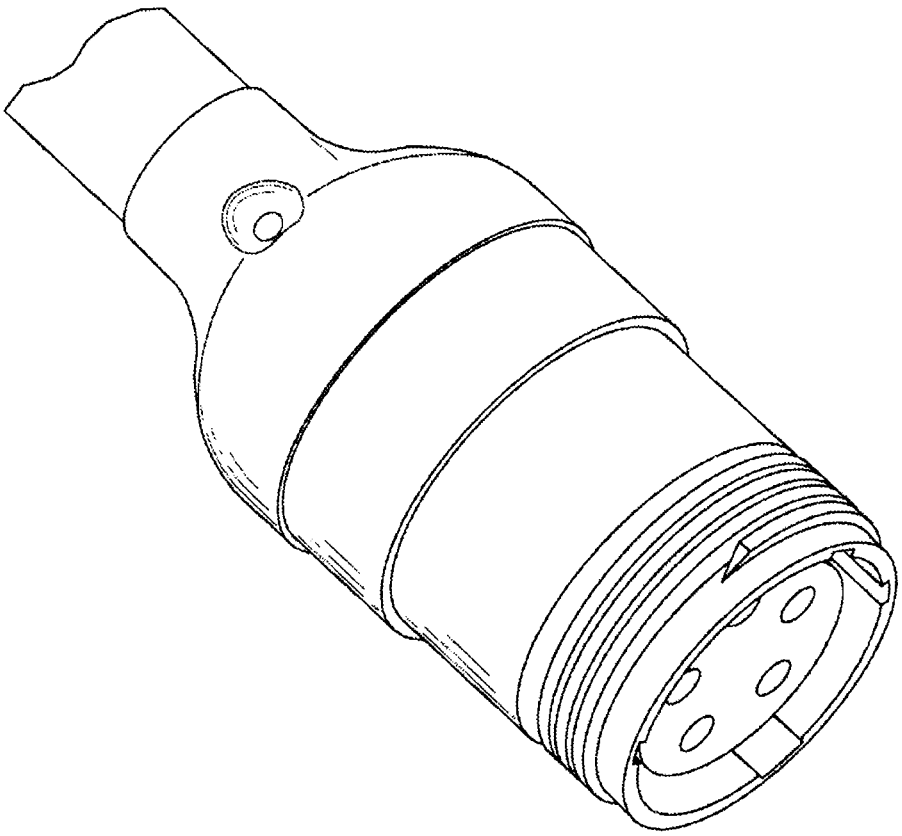
FIG. 8 is front side perspective isometric view of the Class L connector shell of FIG. 2B with the pre-mold material.
Figure 9:
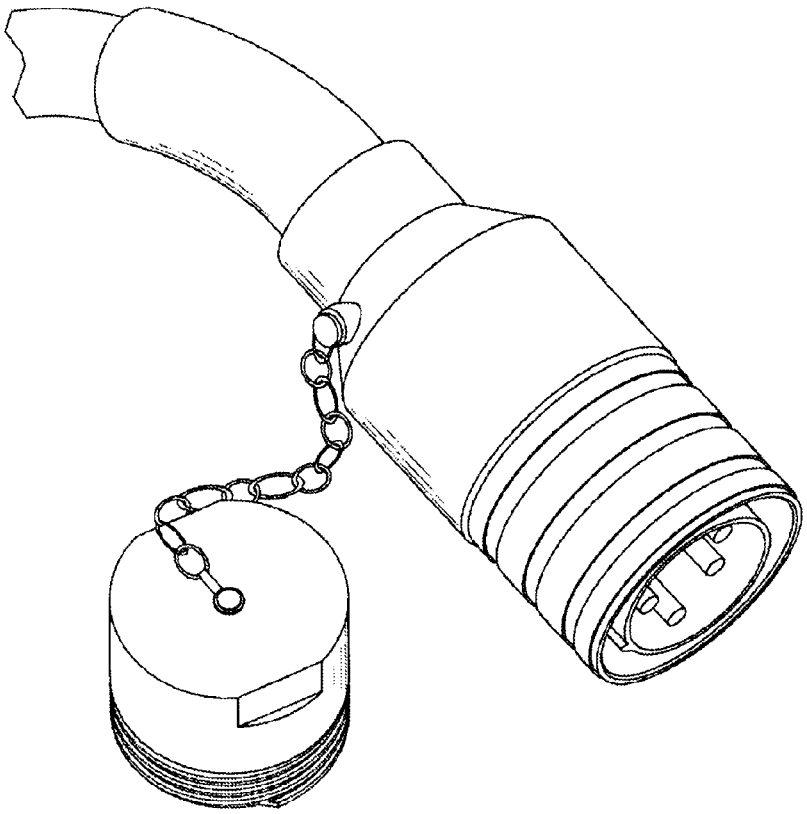
FIG. 9 is front side perspective isometric view of the Class L connector shell of FIG. 2A with the over-mold material and a dust cap.

Referring to FIG. 8, a pre-mold material (preferably polypropylene, however any other material suitable to the desired end purpose may be used) may be introduced to the assembly via injection (or any other suitable method) to cover and/or encapsulate a portion of the base end 110 of the connector shell 102, wherein the pre-mold material completely fills the plug/socket shell cavity 109 as well as covering the base end of the connector shell 102, the conductor connections to the power and ground carriers 114, 116 and a portion of the cable (if desired), as shown in operational block 204. It should be appreciated that the pre-mold material not only fills the plug/socket shell cavity 109 to encapsulate the connections between that conductors and pins/sockets, but it also covers and fills in the knurls/grooves 128 on the outer surface of the plug/socket shell portion 112. This advantageously prevents/limits longitudinal movement of the pre-mold material along the length of the outer surface 126 and/or rotational movement around the circumference of the outer surface 126. Referring to FIG. 9, an over-mold material (preferably Santoprene, however any other material suitable to the desired end purpose may be used) is over-molded over the pre-mold material, as shown in operational block 206, where the over-mold material also covers at least a portion of the associated cabling and is configured to act as a strain relief as discussed hereafter. If desired, a mounting article (such as a threaded insert or a hex nut) may be molded into the over-mold and/or pre-mold material to secure a dust cap to the shell. In accordance with the present invention, this over-mold configuration advantageously acts as an effective strain relief as discussed hereinafter.

It should be appreciated that the present invention can be used with other types of cabling and is not limited to Class L connectors. Additionally, it should be further appreciated that the present invention may be accomplished using any method or device suitable to the desired end purpose. For example, the invention may use some or all of the characteristics and/or techniques as disclosed in U.S. patent application Ser. No. 12/856,220, filed on Aug. 13, 2010 and entitled "An Electrical Connector and A Method for Manufacturing Same," the contents of which are incorporated herein by reference in its entirety.

Accordingly, the electrical connector 100 of the present invention may be configured with different shell sizes ranging from 28 to 52 (greater or smaller) and may be configured to operate with conductor sizes that range from size 6 AWG to 4/0 AWG (greater or smaller) and may be used with connectors that are configured to operate with electrical currents ranging from 40 to 200 amperes (greater or smaller). Additionally, the method of the invention as disclosed herein may be used with other embodiments and thus may be used with any size or type of connector and is thus, not limited to the embodiment disclosed herein.

It should be appreciated that the pre-mold material provides a mechanical bond between the cable and the connector and fully encapsulates the conductors and the wiring terminals to provide strain relief and to secure wire terminations. The pre-mold material also insulates the conductors and terminals to eliminate shorting between the conductors and to provide environmental sealing of the terminations. This advantageously acts to prevent infiltration of contaminants and also eliminates pushed pins (i.e. pins that are inadvertently pushed back into the connector) because the pre-mold material fills the terminal housing, capturing the contacts and preventing them from being pushed back into the connector housing. Furthermore, the over-mold material absorbs impact and also acts to protect the internal conductors (for example, at least one material, Santoprene®, also provides a resistant to a wide variety of chemicals). Moreover, because the over-mold material covers a portion of the associated cabling, the over-mold material advantageously provides protection to the cable/connector by acting as a flexible strain relief that improves the flex life of the cable and prevents premature wear and damage to the cable jacket. Accordingly, the over-mold material is advantageously configured to cover a portion of the electrical connector and cable to provide an ergonomic design which achieves a firm gripping surface for safe handling of the connectors. This over-mold configuration also allows a customer/purchaser to mold in of an optional custom logo or design for easy identification on the connector. Moreover, the over-mold material allows for directional arrows to be molded into the connector to assist with the correct alignment for easy mating, as well as molded-in connector information for easy reference and identification of the connector type and specifications.

Figure 10:
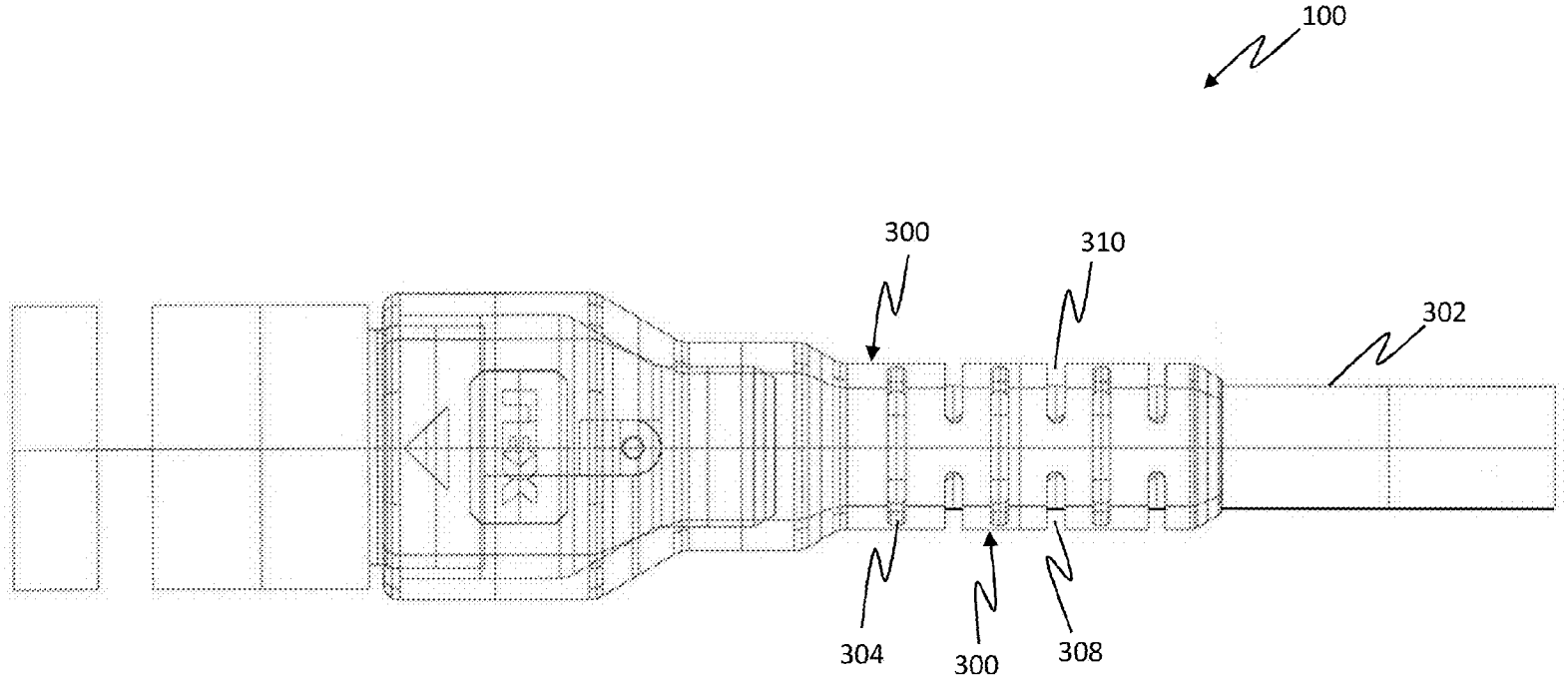
FIG. 10 is side view of the Class L connector shell of FIG. 2A showing one embodiment of a strain relief, in accordance with an exemplary embodiment of the invention.
Figure 11A:
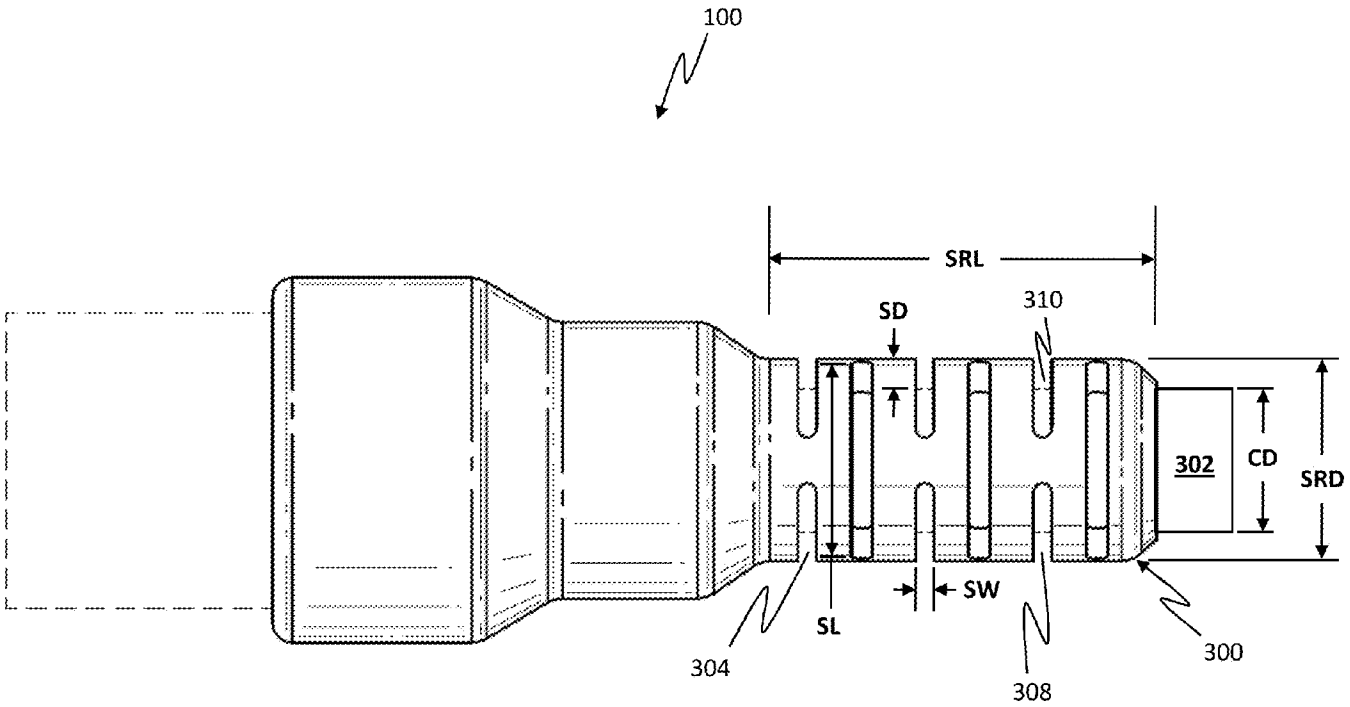
FIG. 11A side view of the Class L connector of FIG. 10 showing a closer view of the strain relief.

Referring to FIG. 10 and FIG. 11A, the electrical connector 100 includes an improved strain relief 300, in accordance with an exemplary embodiment of the invention. The strain relief 300 is formed by the over-mold material and has a strain relief diameter SRD and a strain relief length SRL, where the SRL covers all or a portion of the pre-mold material and a portion of the cable 302, wherein the cable 302 includes a cable diameter CD. It should be appreciated that the strain relief length (SRL) is preferably about 45% to 50% of the minimum bend radius (MBR) of the cable 302, where the MBR of the cable 302 may be determined as discussed further hereinafter or via any other method suitable to the desired end purpose. However, it is contemplated that the strain relief length (SRL) may range from about 30% to about 60% of the minimum bend radius (MBR) of the cable 302.

The strain relief 300 includes a plurality of slots 304 distributed along the length of the strain relief 300 and partially around the circumference of the strain relief. The plurality of slots 304 are configured in slot pairs having a first slot 308 and a second slot 310 and are located such that for each slot 308, 310 located along the length of the strain relief 300, there is a corresponding slot 310, 308 located on the opposing side of the strain relief 300. It should be appreciated that each of the slots 308, 310 are configured to extend partially along the circumference of the strain relief 300 to be separated from the slot 310, 308 on the opposing side of the strain relief by a body portion 312 of the strain relief 300. Furthermore, each of the slot pairs 308, 310 along the length of the strain relief 300 is offset from the adjacent slot pair 308, 310 along the circumference of the strain relief 300 by 90° . It should be appreciated that the slot pairs 308, 310 may be distributed equally along the length of the strain relief 300 or they may be distributed along the length of the strain relief 300 to focus on desired stress points (for example, near the beginning/ends of the strain relief 300). Moreover, each of the slots 308, 310 include a slot width SW, a slot length SL and a slot depth SD, wherein the slot width SW ranges from about 1/10 to 1/25 of the length of the strain relief 300 and the slot length is approximately equal to the diameter of the strain relief. It should be appreciated that the strain relief diameter (SRD) is approximately equal to 1.2 to 1.5 times the cable diameter CD, as desired. Thus, an approximate size of the strain relief diameter SRD can be expressed as:

$$SRD=CD*(1.35\pm0.15).$$

Moreover, because in an exemplary embodiment the slots 304 have a slot depth SD down to the jacket of the cable, it follows that an approximate size of the slot depth SD can be expressed as:

$$SD=(SRD-CD)/2\pm0.25.$$

It should be appreciated as the cable 302 is bent, relative to the electrical connector 100, the strain relief 300 advantageously works to distribute and limit the strain on the connection between the cable 302 and the connector 100. Another advantage is that because the strain relief 300 is constructed from the over-mold material, it resists harsh and environments and there are no metal shards or wires to break and cause injury to cable handlers like the Kellems grip. This is because as the cable 302 is being bent, the slots 304 on the side of the strain relief 300 in the direction of the bend are being compressed so that eventually a portion of the slot sides will contact each other. Simultaneously, the slots 304 on the side of the strain relief 300 in the opposing direction of the bend are being stretched so that the sides of the slots are pulled away from each other. Thus, the bending forces are being directed to the outer corners of the slots on the side in the direction of the bend and to the inner corners (i.e. near the cable) of the slots on the side in the direction opposite of the bend.

Figure 11B:
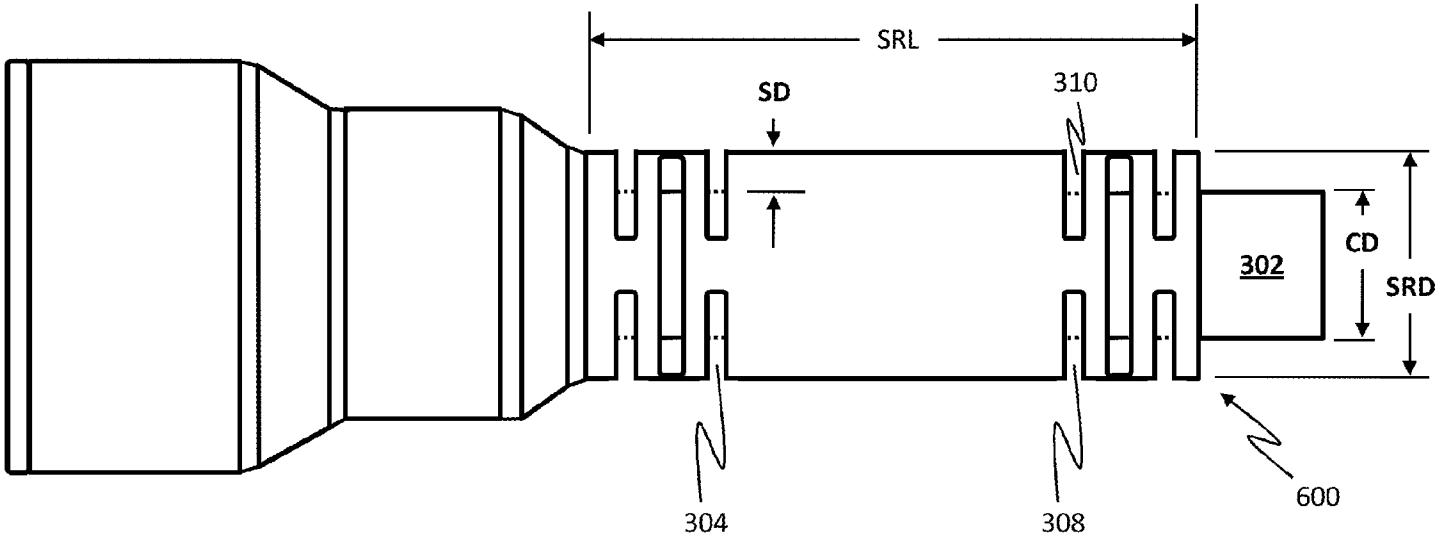
FIG. 11B is side view of the connector shell of FIG. 10 showing another embodiment of a strain relief.

Referring to FIG. 11B, another embodiment of the strain relief 600 is shown where the slots are arranged to be proximate the ends of the strain relief. This embodiment may be more advantageous in applications where the cable is more likely to the bent closer to the connector, such as that used with power cords for standard appliances or Ethernet cables.

Regarding the determination of the minimum bend radius (MBR) of the cable 302, the MBR may be determined by referring to acceptable standards (e.g. National Electrical Code (NEC) articles 300-34, 334-11 and 336-16) or the Insulated Cable Engineers Association (ICEA)) or the MBR may be determined via calculation (for example, MBR=6*D, where D is the diameter of the cable 302). It should be appreciated that the minimum bend radius may also be dependent upon the specific cable being used.

Figure 13:
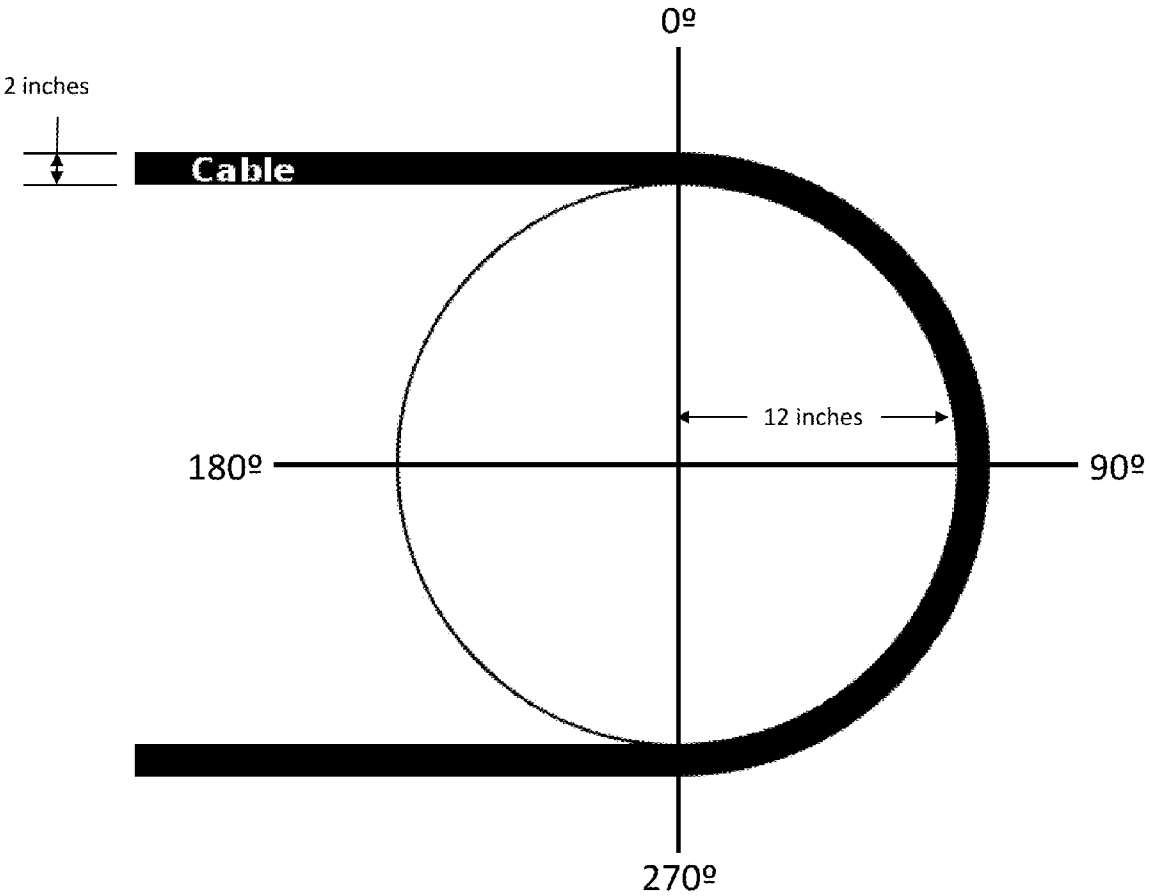
FIG. 13 is a side view showing a portable conductor cable 320 being bent around a radius of 12 inches.

It is known that the minimum bend radius (MBR) is usually expressed as multiples of the wire diameter and is typically measured relative to the inside curvature of the cable or wire that is being bent. The MBR typically refers to the approximate limit that a cable 302 can be bent without kinking it, damaging it or shortening its life. Thus, it stands to reason that the smaller the MBR, the more flexible the cable 302. Referring to FIG. 12 a table illustrating a simplified version of actual, more detailed, industry MBR recommendations for different cable types is shown. Referring to FIG. 13, a portable conductor cable 320 is shown being bent around a radius of 12 inches. If we assume that the cable 320 is at its MBR, then we can determined from the table in FIG. 12, that the overall diameter of the cable 320 is about 2 inches. For more precise technical information regarding minimum bend radius' reference can be made to NEC Articles 300-34, 334-11, and 336-16 as well as Appendix H of ICEA S-66-524 and ICEA S-68-516. Additionally, other reference standards may also apply depending upon the technological filed, such as the International Telecommunications Union ITU-T G.651, ITU-T G.652 standards that govern the characteristics of a 50/125 μm multimode graded index optical fiber cable and characteristics of a single-mode optical fiber cable, respectively. It should be appreciated that observing the MBR of a cable is essential to the lifespan, safety and proper operation of the cable and an adequate strain relief is necessary to protect that cable. For example, if a fiber optic cable exceeds its MBR, the cable could break or the light being propagated within the cable may not be able to traverse the bend in the cable and thus, cease to function properly, if at all.

It should be appreciated that the slot width SW, the slot length SL and/or the slot depth SD may be chosen to give the strain relief more or less support and pliability as desired or based on application and/or to enhance the tactile feel of the electrical connector 100. It should also be appreciated that the novel and unique configuration of the slots of the strain relief 300, 600 provide superior strain relief protection, while helping to provide for an electrical connector that is more aesthetically pleasing, user friendly (with a more pleasant and easy to use feel), durable, electrically insulated, and flexible. It should also be appreciated that although as described herein, the slot depth SD is shown as going down to the cable jacket, it is contemplated that slot depths SD that do not go all the way down to the cable jacket may also be used. For example, a slot depth SD that only goes half way to the cable jacket provides for a strain relief that does not bend as easy and thus, provides more protection and a more rigid feel. As such, the slot depth SD may be chosen as desired (such as for greater/lesser flexibility and/or relief). This may be desirable for cables assemblies having smaller diameters and that are subject to more applications that include repeated bending and unbending.

Figure 14:
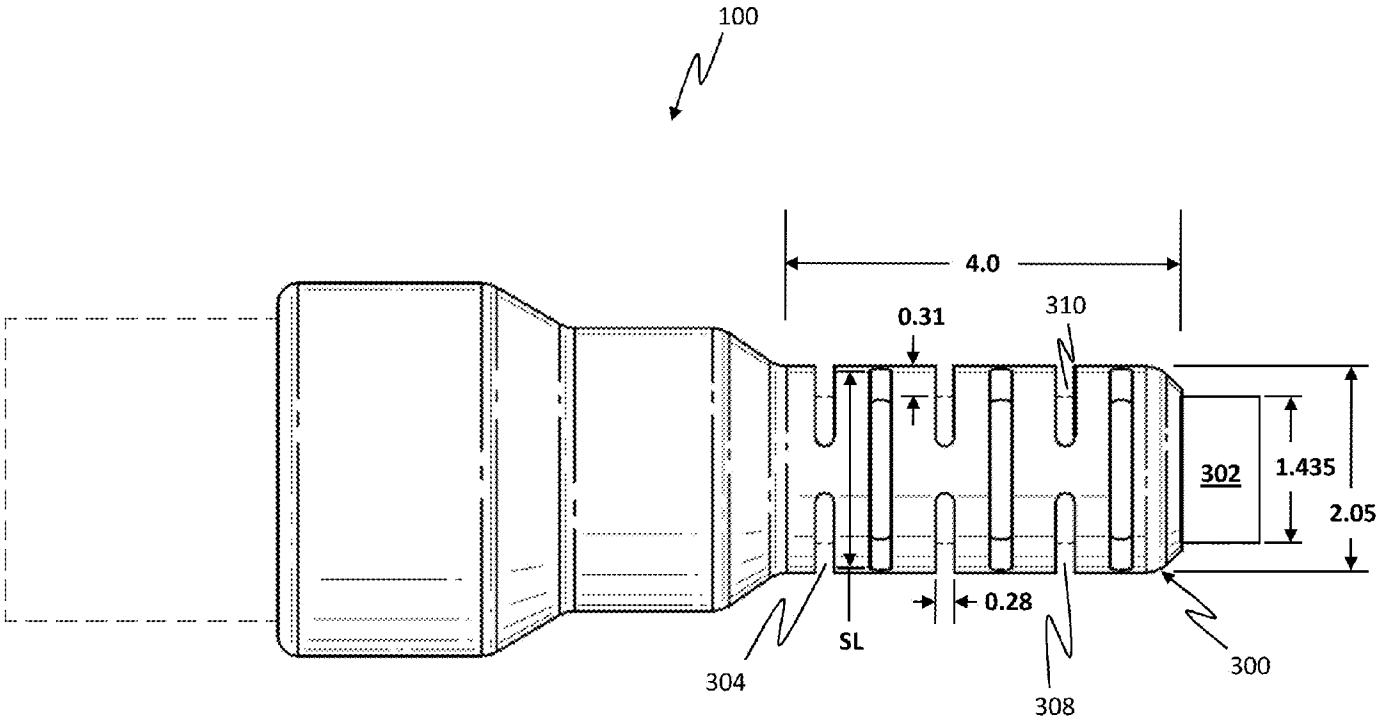
FIG. 14 is a side view of the Class L connector of FIG. 10 configured for use with a 100 Amp current application.

Referring to FIG. 14, one example of an electrical connector (female type) having a strain relief 300, in accordance with an exemplary embodiment is illustrated, where the connector is attached to a portable cable 302 and is configured for use with 100 Amp applications. As shown, the cable 302 includes a cable diameter CD of about 1.435 inches, while the strain relief 300 includes a SRL of about 4 inches, a SRD of about 2.05 inches and a plurality of slots 304 which are evenly distributed along the length of the strain relief 300. In accordance with the present invention, each of the slots 304 include a slot width SW of about 0.28 inches and a slot depth SD of about 0.31 inches. Accordingly, referring to the table in FIG. 11B, the minimum bend radius for this cable is about 8.61 (i.e. MBR=6×1.435).

Figure 15:
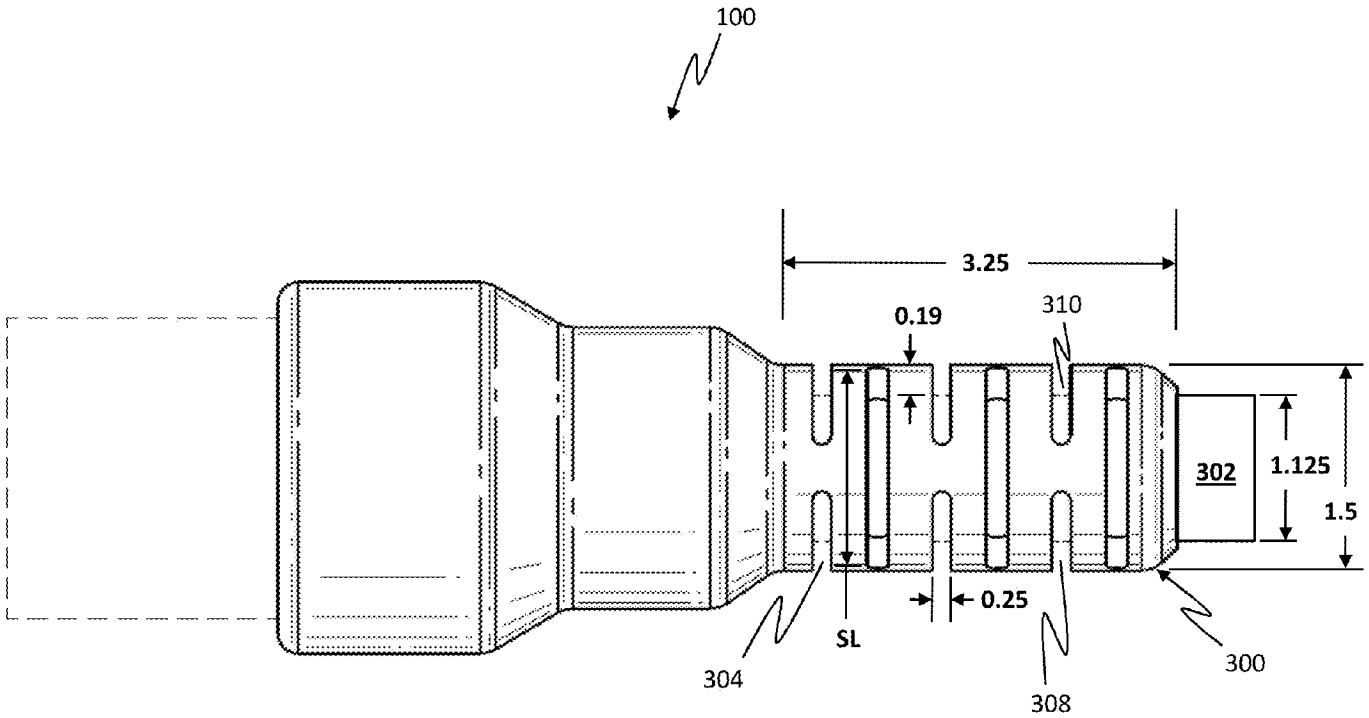
FIG. 15 is a side view of the Class L connector of FIG. 10 configured for use with a 60 Amp current application.

Referring to FIG. 15, another example of an electrical connector (male type) having a strain relief 300, in accordance with an exemplary embodiment is illustrated, where the connector is attached to a portable cable 302 and is configured for use with 60 Amp applications. As shown, the cable 302 includes a cable diameter CD of about 1.125 inches, while the strain relief 300 includes a SRL of about 3.25 inches, a SRD of about 1.5 inches and a plurality of slots 304 which are evenly distributed along the length of the strain relief 300. In accordance with the present invention, each of the slots 304 include a slot width SW of about 0.25 inches and a slot depth SD of about 0.19 inches. Accordingly, referring to the table in FIG. 12, the minimum bend radius (MBR) for this cable is about 6.75 (i.e. MBR=6×1.125).

Furthermore, it should be appreciated that the electrical connector of the present invention (male and female) is qualified to MIL-DTL-22992 standards, with the following tests: Dielectric Voltage Withstand, Insulation Resistance Test, Submersion Test, Drop Test and Cable Pull Force. Accordingly, the connector in accordance with the present invention maintains the required conductive coating and continuity from shell to ground per MIL-DTL-22992 as well as Environmental Rating—Watertight per MIL-DTL-22992.

It should be appreciated that the present invention may be used for any field of technology that employs cables and also may include other embodiments that are also applicable in any field of technology that employs cables. For example, the present invention may be used for connectors prevalent in the fiber optic, medical, industrial, geological and/or the entertainment fields. Furthermore, it should be appreciated that the sizes and dimensions as disclosed herein are given in inches and are not meant to be limiting. Rather the invention is meant to include various other sizes and units as desired and as suitable to the desired end purpose.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. An over-mold strain relief for an electrical connector-cable combination, comprising:

an electrical connector assembly including, an electrical connector having an electrical connector base; and an electrical cable having a minimum bend radius and being connected to the electrical connector proximate the connector base; and an over-mold material, associated with the electrical connector assembly to cover a portion of the electrical connector and the electrical cable, wherein the over-mold material forms a strain relief portion having a strain relief portion length that covers the cable, wherein the strain relief portion includes a plurality of slots which are distributed along the strain relief portion length and wherein the strain relief portion length is within the range of between about 30% to about 60% of the minimum bend radius of the cable.

2. The over-mold strain relief of claim 1, wherein the plurality of slots includes six slot pairs, each of the slot pairs including a first slot located on one side of the strain relief and a second slot located directly on an opposing side of the strain relief.

3. The over-mold strain relief of claim 2, wherein the slot pairs are configured such that each slot pair is oriented to be offset by 90° along the circumference of the strain relief from an adjacent slot pair.

4. The over-mold strain relief of claim 1, wherein the plurality of slots are distributed evenly along the length of the strain relief portion.

5. The over-mold strain relief of claim 1, wherein the strain relief portion includes a strain relief diameter, wherein the strain relief diameter is about 1.2 to about 1.5 times the cable diameter.

6. The over-mold strain relief of claim 1, wherein the strain relief portion includes a strain relief diameter, wherein the strain relief diameter is given by the equation:

$$SRD=CD*(1.35\pm0.15),$$

wherein SRD is strain relief diameter and CD is the diameter of the cable in inches.

7. The over-mold strain relief of claim 1, wherein each of the plurality of slots includes a slot length, a slot depth and a slot width, wherein the slot length is about equal to the strain relief diameter;

the slot width ranges from about 1/10 to about 1/25 of the length of the strain relief portion; and the slot depth is given by the equation:

$$SD=(SRD-CD)/2\pm0.25,$$

wherein SD is slot depth, SRD is strain relief diameter and CD is the diameter of the cable in inches.

8. The over-mold strain relief of claim 1, wherein the strain relief portion length is between about 45% to about 50% of the minimum bend radius of the cable.

9. The over-mold strain relief of claim 1, wherein the over-mold material is constructed from a thermoplastic vulcanizate (TPV) material.

10. An over-mold strain relief for an electrical connector-cable combination, comprising:

an electrical connector assembly including, an electrical connector having an electrical connector base; and an electrical cable having a minimum bend radius and being connected to the electrical connector proximate the connector base; and an over-mold material, associated with the electrical connector assembly to cover a portion of the electrical connector and the electrical cable, wherein the over-mold material forms a strain relief portion having a strain relief portion length that covers the cable, wherein the strain relief portion length is within the range of between about 30% to about 60% of the minimum bend radius of the cable.

11. The over-mold strain relief of claim 10, further comprising a plurality of slots which are distributed along the strain relief portion length.

12. The over-mold strain relief of claim 11, wherein the plurality of slots includes six slot pairs, each of the slot pairs including a first slot located on one side of the strain relief and a second slot located directly on an opposing side of the strain relief.

13. The over-mold strain relief of claim 11, wherein the slot pairs are configured such that each slot pair is oriented to be offset by 90° along the circumference of the strain relief from an adjacent slot pair.

14. The over-mold strain relief of claim 12, wherein the plurality of slots are distributed evenly along the length of the strain relief portion.

15. The over-mold strain relief of claim 10, wherein the strain relief portion includes a strain relief diameter, wherein the strain relief diameter is about 1.2 to about 1.5 times the cable diameter.

16. The over-mold strain relief of claim 10, wherein the strain relief portion includes a strain relief diameter, wherein the strain relief diameter is given by the equation:

$$SRD=CD*(1.35\pm0.15),$$

wherein SRD is strain relief diameter and CD is the diameter of the cable in inches.

17. The over-mold strain relief of claim 12, wherein each of the plurality of slots includes a slot length, a slot depth and a slot width, wherein the slot length is about equal to the strain relief diameter;

the slot width ranges from about 1/10 to about 1/25 of the length of the strain relief portion; and the slot depth is given by the equation:

$$SD=(SRD-CD)/2\pm0.25,$$

wherein SD is slot depth, SRD is strain relief diameter and CD is the diameter of the cable in inches.

18. The over-mold strain relief of claim 10, wherein the strain relief portion length is between about 45% to about 50% of the minimum bend radius of the cable.

19. The over-mold strain relief of claim 10, wherein the over-mold strain relief is constructed from thermoplastic vulcanizate (TPV) material.

20. A method for molding an over-mold strain relief, the method comprising:

creating an assembled connector assembly by connecting the conductors of a cable to an electrical connector, wherein the cable as a minimum bend radius;

associating the assembled connector assembly with an over-mold mold; and introducing a thermoplastic material into the over-mold mold to cause the thermoplastic material to cover at least a portion of the electrical connector and the cable, where the thermoplastic material that covers at least a portion of the cable is configured to have a material length and a plurality of slots distributed along the material length, wherein the material length is between about 30% to about 60% of the minimum bend radius.

* * * * *